United States Patent [19]

Hanneman

[11] 4,311,106

[45] Jan. 19, 1982

[54] SEWING MACHINE WITH UPPER AND LOWER WORKPIECE TRANSPORTERS

[75] Inventor: Franz Hanneman, Detmold, Fed. Rep. of Germany

[73] Assignee: Dürkoppwerke GmbH, Bielefeld, Fed. Rep. of Germany

[21] Appl. No.: 89,860

[22] Filed: Oct. 31, 1979

[30] Foreign Application Priority Data

Nov. 6, 1978 [DE] Fed. Rep. of Germany ..... 2848123

[51] Int. Cl.[3] ..... D05B 27/16

[52] U.S. Cl. ..... 112/313; 112/304

[58] Field of Search ..... 112/313, 312, 304, 121.26, 112/305, 303, 314

[56] References Cited

U.S. PATENT DOCUMENTS

| | | | |
|---|---|---|---|
| 2,974,617 | 3/1961 | Hacklander | 112/313 |
| 3,368,507 | 2/1968 | Orth | 112/313 X |
| 3,800,719 | 4/1974 | Rockerath | 112/304 |
| 4,037,546 | 7/1977 | Kleinschmidt | 112/121.26 |
| 4,109,595 | 8/1978 | Ducol et al. | 112/312 X |

FOREIGN PATENT DOCUMENTS

| | | | |
|---|---|---|---|
| 13364 | 8/1880 | Fed. Rep. of Germany | 112/313 |
| 975242 | 10/1961 | Fed. Rep. of Germany | 112/313 |
| 631245 | 12/1961 | Italy | 112/304 |

*Primary Examiner*—H. Hampton Hunter
*Attorney, Agent, or Firm*—Karl F. Ross

[57] ABSTRACT

A sewing machine designed to stitch together two stacked fabric layers advancing at different speeds comprises an upper and a lower conveyor belt coupled with a common drive shaft by a differential gearing. The relative speed of the two conveyor belts can be manually adjusted with the aid of a friction coupling comprising two mutually parallel larger disks with relatively offset axes and overlapping surface areas contacted by a smaller disk perpendicular thereto, the latter disk being displaceable in a common axial plane of the two larger disks to vary their transmission ratio.

5 Claims, 4 Drawing Figures

SEWING MACHINE WITH UPPER AND LOWER WORKPIECE TRANSPORTERS

FIELD OF THE INVENTION

My present invention relates to a sewing machine wherein two stacked layers of a workpiece, generally a fabric, are advanced past a vertically reciprocating needle at relatively variable rates whereby one layer has an excess of material over the other layer after they have been stiched together.

BACKGROUND OF THE INVENTION

Already a century ago it has been proposed (see German Pat. No. 13,364 of 1880) to use an upper and a lower transporter for separately displacing two fabric layers to be stitched, each transporter being designed as an intermittently operable feed dog whose motions are synchronized with the needle motion and which clamp the two layers between them. By changing the transport stroke of one of these feed dogs, specifically the upper one, a desired amount of excess material can be introduced in the corresponding fabric layer. Since the stroke adjustment of such a transport mechanism can be performed only on standstill, a speed difference once selected must be maintained as long as the machine is in operation. Subsequent improvements have included the provision of a scale for measuring the transport stroke, e.g. as described in German Pat. No. 975,242 (1961).

Even with precise presetting, however, unavoidable differences in the movable masses of the two intemittently operating transporters result in cumulative deviations which may add up to undesired offsets between the two layers. A continuous intervention of the operator has therefore been hitherto necessary to maintain the desired relationship between the rates of advance of these layers. Such intervention, however, is not practical in plants with large numbers of automatic high-speed sewing machines in which the task of the operators is limited to an initial positioning of the workpieces and their removal from the machines.

OBJECTS OF THE INVENTION

An important object of my present invention, therefore, is to provide an improved transport mechanism for reliably advancing two stacked workpiece layers at selectively different rates, especially in an automatic sewing machine.

Another object is to provide a transport mechanism of this kind which can be adjusted during operation of the machine to vary the speed difference between the two layers.

SUMMARY OF THE INVENTION

I realize these objects, in accordance with my present invention, by providing an upper and a lower conveyor belt serving as the transport means, these belts having parallel horizontal runs which are codirectionally displaced by the associated drive means to advance the two stacked workpiece layers between them. The relative rate of displacement of the two horizontal runs can be varied with the aid of adjustable transmission means inserted between the drive means and the conveyor belts.

Advantageously, pursuant to a more particular feature of my invention, the interposed transmission means comprises a differential gearing provided with a speed-changing coupling between its output shafts. The speed-changing coupling is preferably of a frictional type known per se, including a pair of axially spaced outer disks mounted with overlapping surface areas on the two mutually parallel output shafts, these overlapping surface areas being engaged by an intermediate friction disk which is perpendicular to their surfaces and movable substantially in a common axial plane of the two outer disks in order to vary their speed ratio.

BRIEF DESCRIPTION OF THE DRAWING

The above and other features of my present invention will now be described in detail with reference to the accompanying drawing in which.

SPECIFIC DESCRIPTION

Figure 1:
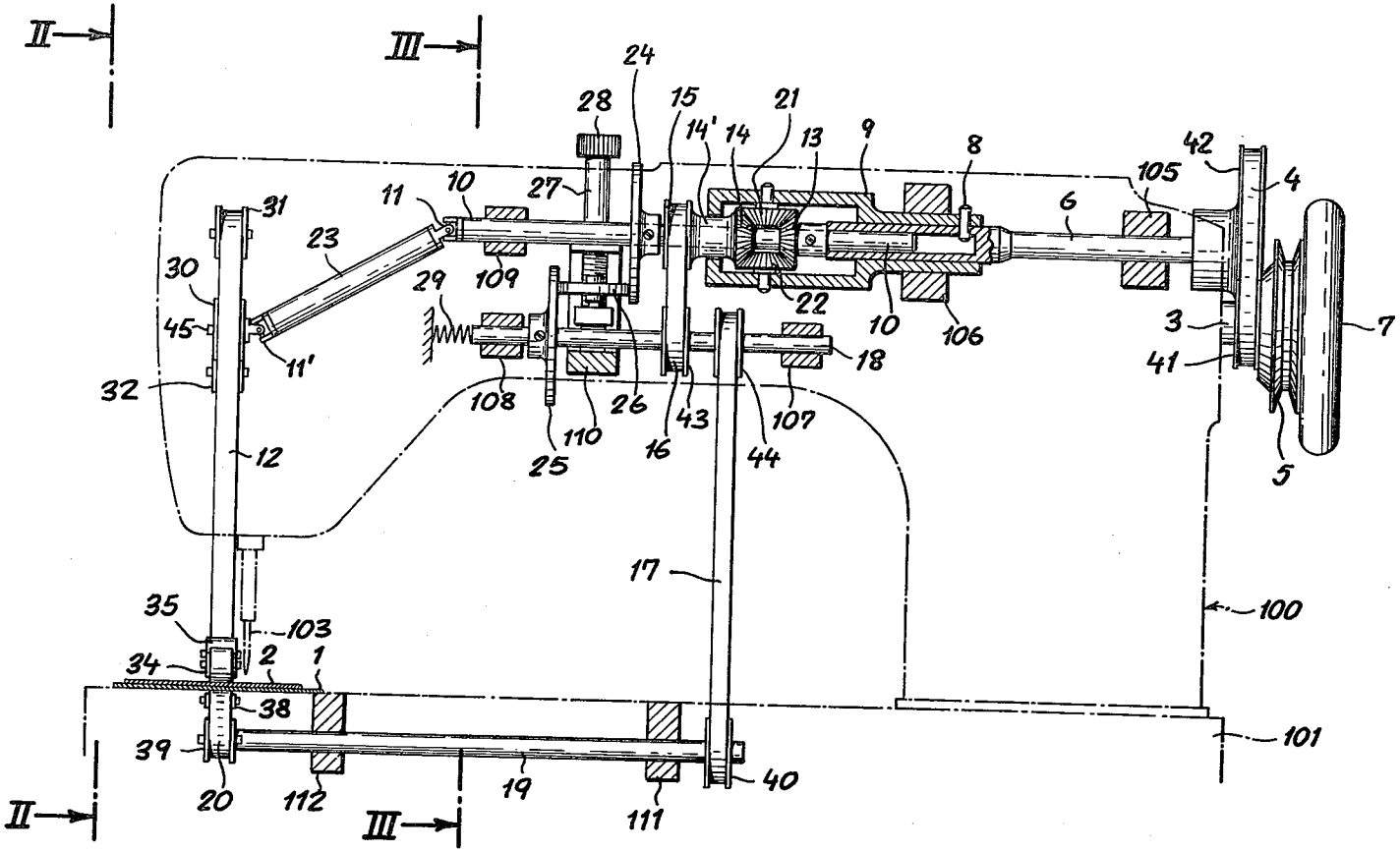
FIG. 1 is a side-elevational view of a transport mechanism according to my invention in an otherwise conventional sewing machine illustrated only diagrammatically.
Figure 2:
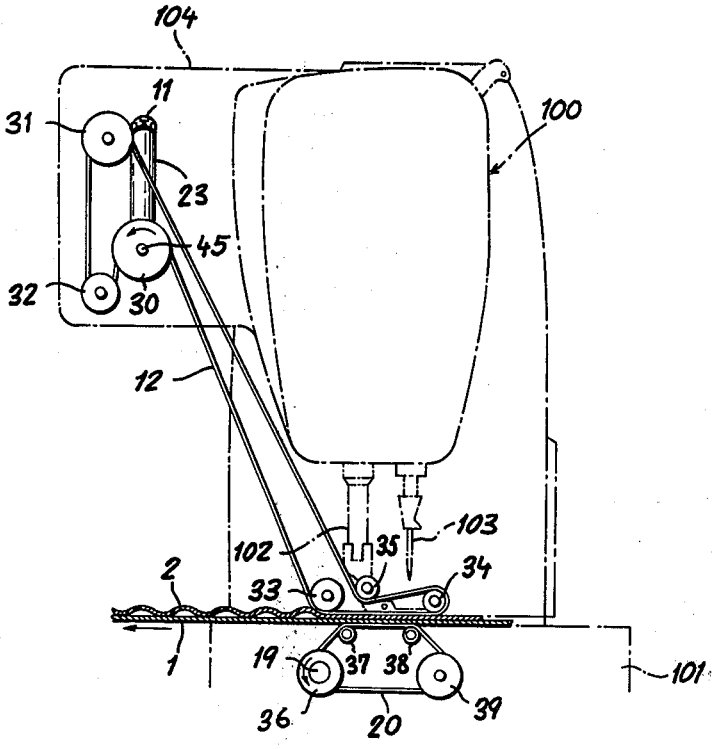
FIG. 2 is an end-elevational view of the mechanism as seen on the line II—II of FIG. 1.
Figure 3:
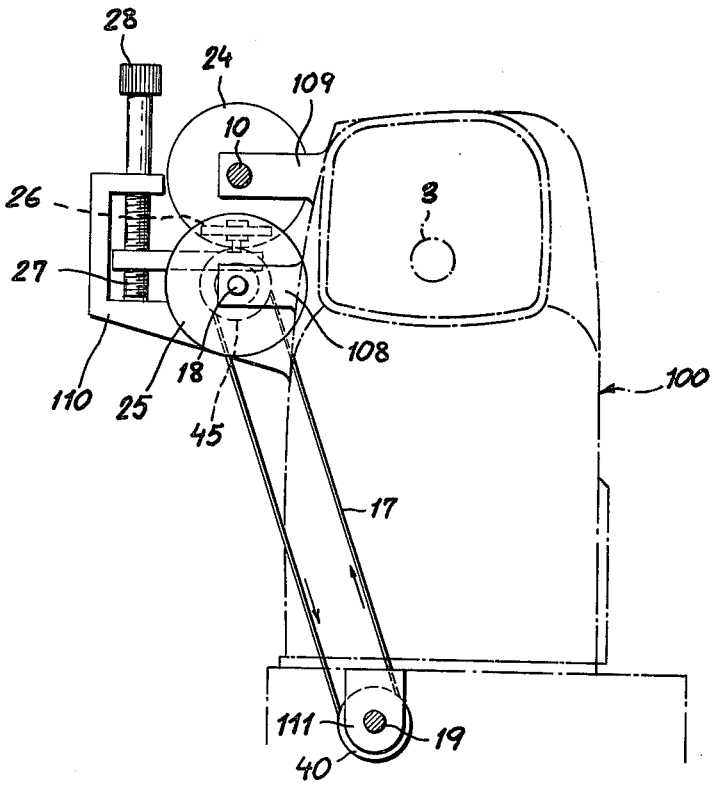
FIG. 3 is a similar view taken in cross-section on the line III—III of FIG. 1.
Figure 4:
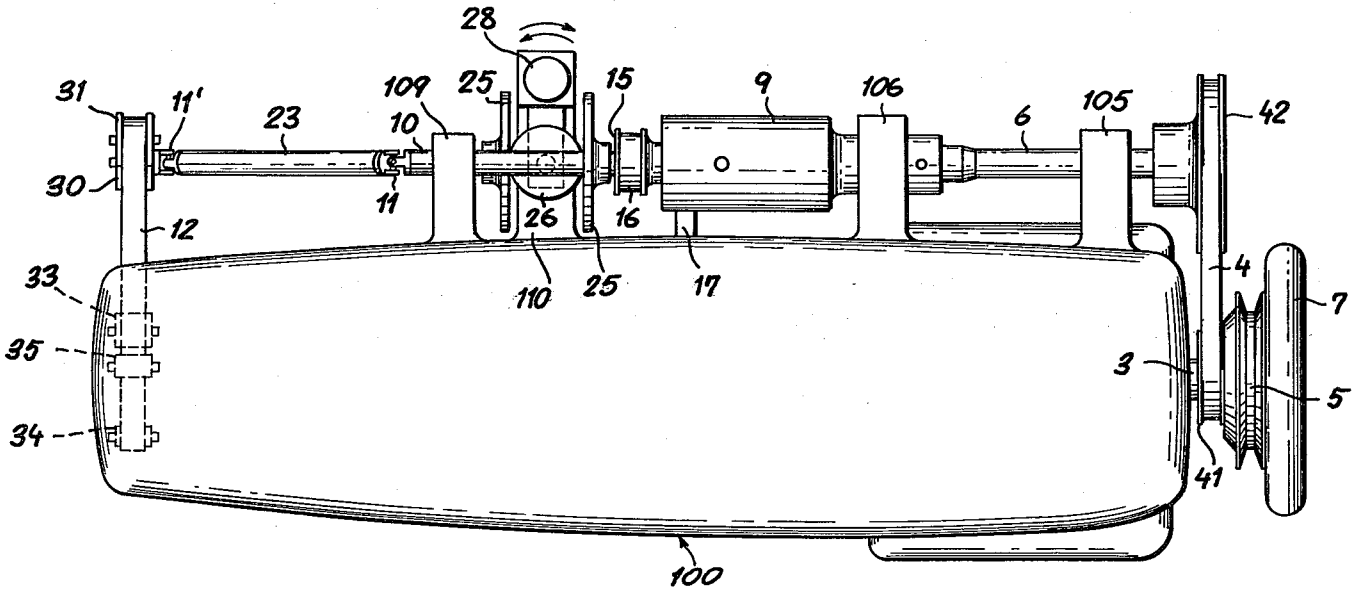
FIG. 4 is a top view of the machine and its transport mechanism.

In FIGS. 1-3 I have shown in phantom lines the outline of a sewing machine 100, seen in full lines in FIG. 4. The machine has a table 101 on which two stacked fabric layers 1, 2 are displaceable below a presser foot 102 in the path of a vertically reciprocating needle 103 coupled with a horizontal main shaft 3. The latter carries the usual handwheel 7 and a pulley 5 driven by a belt from a nonillustrated electric motor.

The arm of the machine 100 is provided with a lateral housing attachment 104, shown only in FIG. 2, accommodating part of a transport mechanism including an ancillary shaft 6 which is rotated by shaft 3 through the intermediary of a step-down transmission including two pulleys 41, 42 spanned by a belt 4. Shaft 6 is journaled within housing attachment 104 in a pair of bearing lugs 105, 106 and is connected by a pin 8 with a housing 9 of a differential gearing of a type known per se. An extension shaft 10 rotatably journaled in shaft 6 is rigid with a sun gear 13 meshing with a pair of planet gears 21, 22; another sun gear 14 has a hub 14' rigid with a pulley 15 that is freely rotatable on shaft 10.

Pulley 15 is linked by a belt 16 with another pulley 43 on an ancillary shaft 18 journaled in bearing lugs 107, 108 and disposed directly below shaft 10; the end of the latter shaft remote from tubular shaft 6 is supported by a further bearing lug 109. Shafts 10 and 18 carry two large friction disks 24 and 25 with parallel, axially separated faces having overlapping surface areas as best seen in FIG. 3. A smaller friction disk 26 mounted on a spindle 27 contacts the overlapping surface areas of the counterrotating disks 24 and 25. Contact pressure between disks 24–26 is maintained by a spring 29 acting upon the axially shiftable shaft 18.

Another pulley 44 mounted on shaft 18 is linked by a belt 17 with a pulley 40 on a further shaft 19 horizontally supported below the surface of table 101 by a pair of bearing lugs 111, 112. The opposite end of shaft 19, extending just beyond the path of needle 103, carries a pulley 36 (FIG. 2) engaged by a short endless conveyor belt 20 which passes around two deflecting rods 37, 38 and an idler pulley 39. Rods 37 and 38 define a horizontal run for belt 20 slightly above the level of table 101, enabling this belt to entrain the lower fabric layer 1.

Horizontal shaft 10 is linked by a universal joint 11 with an inclined shaft 23 which is connected through another universal joint 11' with a horizontal stud shaft 45 whose journal bearings, like those of the several deflecting rollers referred to above and hereinafter, have not been illustrated. Shaft 45 carries a sheave 30 entraining another endless conveyor belt 12 around several rollers 31–35; rollers 33 and 34 define a horizontal run for belt 12 which overlies the workpiece-engaging run of belt 20 with a spacing substantially corresponding to the thickness of the two stacked fabric layers 1 and 2. Belt 12, therefore, entrains the upper layer 2 codirectionally with layer 1 but not necessarily at the same speed.

Spindle 27 is mounted on a bracket 110 and carries a knob 28 which is accessible from outside housing attachment 104 for manual adjustment of the position of the smaller friction disk 26. When that friction disk contacts the two larger disks 24 and 25 along equal radii from their respective axes, the two parallel output shafts 10 and 18 of the differential gearing rotate at identical speeds and so do the belts 12 and 20 respectively driven by them. As there is no relative motion between sun gears 13 and 14 in this case, planet gears 21 and 22 do not rotate and the speed of shafts 10 and 18 is the same as that of shaft 6 and differential housing 9. When intermediate disk 26 is shifted in a common axial plane of shafts 10 and 18 toward the periphery of one or the other outer disk 24, 25, the speed ratio is changed so that either the lower layer 1 or the uper layer 2 moves faster than the other layer and accumulates extra material, as is desired in many instances. Such an adjustment can be conveniently made while the machine 100 is in operation. It should be noted that the sum of the rotary speeds of output shafts 10 and 18 is always equal to twice the speed of input shaft 6, a feature inherent in the use of a differential gearing.

The selected speed ratio can be indicated by a non-illustrated pointer coupled with knob 28 and coacting with an associated scale.

I claim:

1. In a sewing machine having transport means for moving two stacked workpiece layers at relatively variable rates past a vertically reciprocating needle adapted to stitch them together, the improvement wherein said transport means comprises an upper conveyor belt and a lower conveyor belt with parallel horizontal runs aligned to advance said layers between them, drive means for actuating said conveyor belts with codirectional displacement of said horizontal runs, and adjustable transmission means between said drive means and said conveyor belts for varying the relative rate of displacement of said horizontal runs.

2. The improvement defined in claim 1 wherein said transmission means comprises a differential gearing with an input shaft connected to said drive means and a pair of output shafts respectively connected to said upper and lower conveyor belts, a speed-changing coupling between said output shafts establishing a variable speed ratio therebetween, and control means linked with said coupling for varying said speed ratio.

3. The improvement defined in claim 2 wherein said output shafts are mutually parallel and are counterrotated by said differential gearing, said coupling comprising a pair of axially spaced outer friction disks mounted with overlapping surface areas on said output shafts and an intermediate friction disk perpendicular to said outer friction disks contacting said overlapping surface areas, said control means comprising a mounting for said intermediate friction disk movable substantially in a common axial plane of said outer friction disks.

4. The improvement defined in claim 3 wherein said outer friction disks are of substantially the same diameter larger than that of said intermediate friction disk.

5. The improvment defined in claim 3 or 4 wherein at least one of said outer friction disks is axially movable, further comprising spring means urging said outer friction disks toward each other.

* * * * *